United States Patent [19]

Prins

[11] Patent Number: 4,951,934

[45] Date of Patent: Aug. 28, 1990

[54] DEVICE FOR STACKING SHEET-LIKE ARTICLES SUCH AS LETTERS

[75] Inventor: Geert J. Prins, Delft, Netherlands

[73] Assignee: Staat Der Nederlanden Staatsbedrijf Der Posterijen, Telegrafie En Telefonie, The Hague, Netherlands

[21] Appl. No.: 272,511

[22] Filed: Nov. 16, 1988

[30] Foreign Application Priority Data

Nov. 20, 1986 [NL] Netherlands ..... 8702786

[51] Int. Cl.[5] ..... B65H 29/44

[52] U.S. Cl. ..... 271/181; 271/214; 271/2; 414/798.7

[58] Field of Search ..... 271/2, 176, 177, 180, 271/181, 214, 215; 414/798.7

[56] References Cited

U.S. PATENT DOCUMENTS

| | | | |
|---|---|---|---|
| 3,062,539 | 11/1962 | Obenshain . | |
| 3,667,623 | 6/1972 | Frazier et al. | 271/181 X |
| 4,019,730 | 4/1977 | Staudinger et al. | 271/181 |
| 4,258,909 | 3/1981 | Müller | 271/181 |
| 4,339,119 | 7/1982 | Sasaki et al. | 271/180 |
| 4,474,366 | 10/1984 | Reider | 271/181 |
| 4,509,739 | 4/1985 | Kurokawa . | |

FOREIGN PATENT DOCUMENTS

| | | | |
|---|---|---|---|
| 282245 | 2/1915 | Fed. Rep. of Germany | 271/181 |
| 669787 | 1/1939 | Fed. Rep. of Germany . | |
| 1216887 | 5/1966 | Fed. Rep. of Germany | 271/180 |
| 1284131 | 11/1968 | Fed. Rep. of Germany . | |
| 2807188 | 8/1978 | Fed. Rep. of Germany . | |
| 134130 | 9/1972 | Netherlands . | |
| 458955 | 1/1937 | United Kingdom . | |

*Primary Examiner*—Joseph J. Rolla

*Assistant Examiner*—David H. Bollinger

*Attorney, Agent, or Firm*—Frishauf, Holtz, Goodman & Woodward

[57] ABSTRACT

The invention relates to a device for stacking flat articles, such as postal items. First guide (9), which form part of a stacker head (7) and which bound a stack of articles (2) already stacked in a stacker bed (1) in a plane of stacking (D), carry out an imposed to-and-fro pulse movement between a rest position (A) and an outermost position (C) transversely to a supply line (3) and in line and level with the stack to make stack space for a short time for an article (2.2) to be stacked, which article is entering at that moment via the supply line (3). The pulse movement can be realized by hanging the first guide (9) on the one hand by way of a first set of parallel leaf springs (17, 18) to a frame part (19, 20, 31, 32) in such a way that they can swing, and on the other hand by coupling them to the driving end (28) of drive (25, 26) carried on bearings in the frame part. In the rest position (A) the stack pressure exerted in the plane of stacking (D) on the first guide (9) of the stacker head (7) will (practically) completely be exerted as a sideways pushing force on the frame part. This fact can be utilized with advantage for a very accurate stack-force measurement. For that purpose the frame part is connected, on the one hand, via a second set of parallel leaf springs (33, 34) to the fixed world (35, 36, 4) and, on the other hand, via a coupling bar (37) to a force transducer (38, 39). A very small sideways displacement of the frame part under the sideways pushing force caused by the stack pressure is registered by the force transducer (39) and converted into a signal which can be used for a change of position, if any, of a stack support (8) for regulating the stack pressure.

14 Claims, 3 Drawing Sheets

DEVICE FOR STACKING SHEET-LIKE ARTICLES SUCH AS LETTERS

A. Background of the invention

1. Field of the invention

Figure 1:
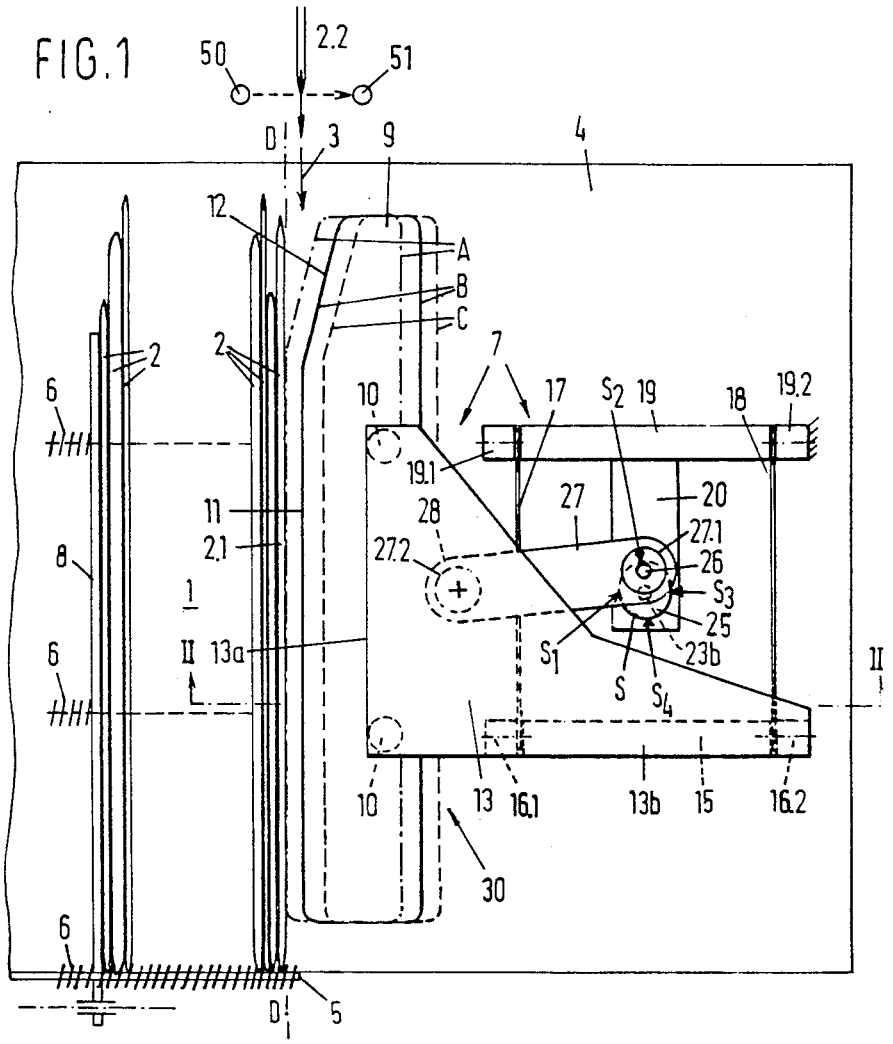

The invention relates to a device for stacking substantially sheet-like articles such as letter-shaped or card-shaped postal items. Devices of this type form in particular part of postal items processing apparatus in the automatic processing process of forwarding postal items, and serve to temporary storing postal items during said process.

2. State of the art

A device for stacking substantially sheet-like articles, such as letters, side by side in an upright state, which articles are separately supplied via a supply path, comprises a. a stacker head provided with first guide means aligned with the supply path, and b. a stacker bin, in which the articles are stacked to form a stack which is bounded on one side by the first guide means, which when in a stack pressing position determine a plane of stacking.

A device of this type is generally known, for example from NL-OS 134130. In the device disclosed in this patent specification a letter supplied is shot at the speed of transport and at a sharp angle of supply $\alpha(\neq 0)$ with regard to the plane of stacking into a notch between the first guide means, in this case a stacking belt mounted on a swivel arm, and the last stacked letter. BeYond the notch this stacking belt runs substantially parallel to the last letter in the stack and is kept in contact with the same under spring pressure. Consequently, a letter shot into the notch will be pulled further on/into the stack by the friction force exerted by the stacking belt on the letter shot in until this letter bumps against stop means forming part of the stacker bin. The angle o has a practically determined value which is such that the rear end portion of a letter supplied will sweep out of the path in good time before a next letter arrives. Moreover the driving working of a turning worm is made use of in or near the notch to promote said sweeping out.

Besides, U.S. Pat. No. 4509739 discloses in this connection the use of a small pressure lever.

Said known devices have a number of drawbacks A certain angle of supply $\alpha \neq 0$ is indispensable. With usual speeds of supply required when processing for example: ten letters to the second a next letter will, as a consequence, bump against the last letter in the stack at a high speed in spite of the fact that there are guide means. If this last letter is uneven because of for instance its contents or due to the fact that it is provided with a window, with labels, stamps, gummed edges and the like, such a next letter will engage with that last letter. This will often lead to damage and disturbances in the stacking process. Besides the stacking belt remains in a slipping contact with the last letter in the stack. This will also quite often lead to damage to the letters. The additive measures necessary to promote said sweeping out will make the device even more complicated and maintenance-intensive.

A stacking device of the aforesaid sort, in which the first guide means moreover carry out a to-and-fro motion, due to which between the first guide means and the stack, at least on the side of the supply path, space will be made for a short time for a next entering article to be stacked, is known from DE-1216887. In general said device is suited for stacking uniform, flat and smooth articles such as folders.

In said case the aforesaid first guide means are formed by a stack support, if desired with a guiding profile adapted to the entering of the articles. This stack support carries out an uninterrupted to-and-fro vibration mainly on the side facing the supply path and substantially at right angles to the plane of stacking. In consequence of this a slot-shaped entrance space will be formed for a short time between the stack support and the stack already formed. This takes place at a frequency independent of and much higher than the frequency at which the folders are presented in the supply path. At a certain acute angle $\alpha \neq 0$ with regard to the plane of stacking, the folders are stowed, preferably in a scaly way, into said substantially wedge-shaped entrance space. Several measures have been given, dependent on the fact whether the article enters at a positive or at a negative angle o with regard to the plane of stacking, for sweeping away the rear end portion of an entering folder out of the path in good time before a next article arrives. The stowing movement indicated can be promoted by making the stack support carry out a to-and-fro motion and at the same time an up-and-down motion in such a way that the slot shutting movement will be attended by the down motion, so that the stack support can push under friction force the folders in the direction of the stacker bin. For that purpose the stack support is coupled to the fixed world (a base plate) in two ways; on the one hand via an eccentrically driving transverse coupling for imposing said simultaneous to/fro and up/down motion, and on the other hand via a springy as well as swivelling coupling permitting the imposed motion.

When utilized for articles such as letters of a rather varying form, weight, dimensions and quality of surface, this technique will show similar drawbacks as already mentioned above. Even the problem of the slipping contact already mentioned can occur in the embodiment with the up and down moving stack support.

A further drawback is that the to-and-fro motion will also be carried out at the moment when there is no supply of articles, which results not only in loss of energy but also in an unnecessary contribution to the ambient noise.

Said drawbacks will also occur when the vibration frequency is chosen equal to the entrance frequency to make a stacking of separate letters feasible.

In many applications of the stacking device of the sort described above, especially when stacks of a considerable size are (have to be) possible, it will be necessary for a good working of such a device to keep the pressure exerted bY letters in the stack on one another within certain limits. This can take place for example by regulating the distance between the stack bounding means on either side of the stack dependent on the instantaneously measured pressure of the stack. The most favourable place to measure the stacking pressure is there where the stacker head is in contact with the last stacked letter in the stack, the stacker head being used as a device for detecting the stacking pressure as already known from the above-cited state of the art (in this case NL-OS 134130 and U.S. Pat. No. 4,509,739). In the known technique the stacker head can be swivelled over a certain angular displacement against a spring pressure supplied, which pressure is opposite to the stacking pressure, and can at the same time operate a fixedly mounted switch contact for switching on/off a drive mechanism for controlling the stacking capacity and, consequently, the stacking pressure in the stacker bin. Such a control is, however, rather slow and rough. This is also caused by the fact that the stacking pressure cannot be evenly detected over the surface with which the stacker head is in contact with the last letter in the stack due to the swivelling suspending position of the stacker head. Consequently, an adequate regulation of the stack pressure will be hampered, which can lead to a slanting state of the letters and other disturbances especially in the case of letters with uneven contents.

Summarizing it can be stated that the technique cited above has the following drawbacks, notably that (i) no or insufficient stack space is offered to a letter entering the stacking device to guarantee an undisturbed entrance of the same;

(ii) if stack space is made, this will not be or insufficiently be attuned to the moment when the letter enters and the time it will take;

(iii) the plane in which the supply of a letter takes place is always at an angle, be it a small one, with regard to the plane in which a letter is in the stack, due to which the good working of the device strongly depends on the stiffness of flexure, the quality of the surface and the evenness of the contents of the letter; and (iv) an adequate place independent stack pressure measurement is not possible.

B. SUMMARY OF THE INVENTION

The object of the present invention is to provide a stacking device of the sort described above, but without said drawbacks. A further object of the present invention is to provide for a stacking device in which stack space is always made only at the right moment, a well balanced stacker head, with which for articles, such as letters, of rather varying form, weight, dimensions, quality of surface and contents it will be possible to realize high stacking speeds while retaining a good quality of stacking.

To that end the invention is characterized in that the plane of supply is substantially parallel to the plane of stacking and in that the to-and-fro motion is an imposed pulse movement from a stack pressure rest position synchronous with the supply, which movement forms a translation approximately perpendicular to the plane of stacking, through it up to beyond the plane of supply. That means that during the pulse movement a free space will be created at the head of the stack, where the supply takes place, and over the whole height of the stack, which free space substantially has the form of a flat box with a thickness varying with the pulse movement and disposed directly in line and level with the supply path. This box has for a short time a shoot-in opening on the supply side into which, if supplied synchronously, that is in good time, from the supply path, an article to be stacked can be shot in without much let or hindrance. When the stacking device according to the invention is utilized in the case of a letter transport with a fixed pitch, the device will be preferably characterized in that starting the pulse movement takes place fixedly dependent on the pitch. For the sake of a flexible attuning of the supply of letters in the supply path and the timely availability of free stack space the device is preferably characterized in that starting the pulse movement takes place dependent on an article detection signal coming from article detecting means in the supply path. By thus making the pulse movement in fact a commanded pulse movement a flexible stacking device will be formed, in which stack space will be created, only when an article actually enters.

A device according to the invention in which, as known per se, the first guide means are provided with a spring coupling as well as with a driving coupling with a frame part forming part of the stacker head is preferably characterized in that the first guide means and the spring coupling will form a mass spring system, 5 which has a frequency of its own which is approximately equal to the frequency which corresponds with the pulse movement imposed via the driving coupling. Owing to this it will be effected that the pulse movement can be easily imposed via the driving coupling. This can, moreover, be promoted, if preferably the driving coupling is set in such a way that the stack pressing rest position of the first guide means will be taken up when the spring coupling is in its outermost position, in which case the pulse movement is started from the stack. To make it superfluous to charge the spring coupling continuously when no pulse movement is carried out, the driving coupling is preferably set in such a way that the stack pressing rest position will be taken up when the spring coupling is not charged, and in which case the pulse movement is started towards the stack.

For realizing the translation movement of the first guide means the device is in a preferred embodiment characterized in that the spring coupling is formed by a first parallel leaf spring guide and in that the driving coupling comprises a connecting rod mechanism provided with a driving end pivotally connected to the first guide means, the connecting rod mechanism being carried on bearings in the frame part in such a position that the movement of the driving end is in a plane substantially orthogonal to the plane of stacking.

The first guide means preferably comprise at least two parallel skate-shaped lead-in guides which are rigidly coupled to one another, the guiding ("slide") sides of which lead-in guides determine the plane of stacking. The advantage of this is that a light construction will be possible. Moreover, the form of such a construction reduces a possible sucking-along working on the last letter in the stack when the pulse movement is started.

The fact that in its normal position the stacker head, or the first guide means which are part of the same has respectively have to take up a fixed or with regard to the pulse movement an almost fixed stack bounding rest position can in a device according to the invention be utilized with advantage to control the stacking pressure. For that reason a device according to the invention is preferably characterized in that the stacker head is connected from inside of or from the frame part to the environment designated as the fixed world, on the one hand via a second parallel leaf spring guide parallel to the first parallel leaf spring guide, and on the other hand via a force transducer. Owing to this it will be possible to carry out, in the plane of stacking, a place-independent measurement of the force which is exerted on the stacker head due to the stacking pressure in the stack. This is particularly of importance in the case of letters with uneven contents.

Further preferred embodiments of the invention are mentioned in the other subclaims.

C. REFERENCES (1) Netherlands patent no. 134130

(2) American U.S. Pat. No. 4,509,739
(3) German Auslegeschrift no. 1216887.

D. BRIEF DESCRIPTION OF THE DRAWING

Figure 2:
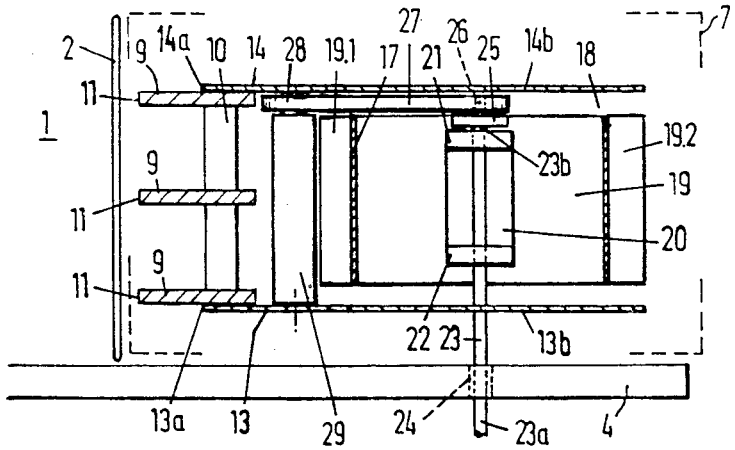
Figure 4:
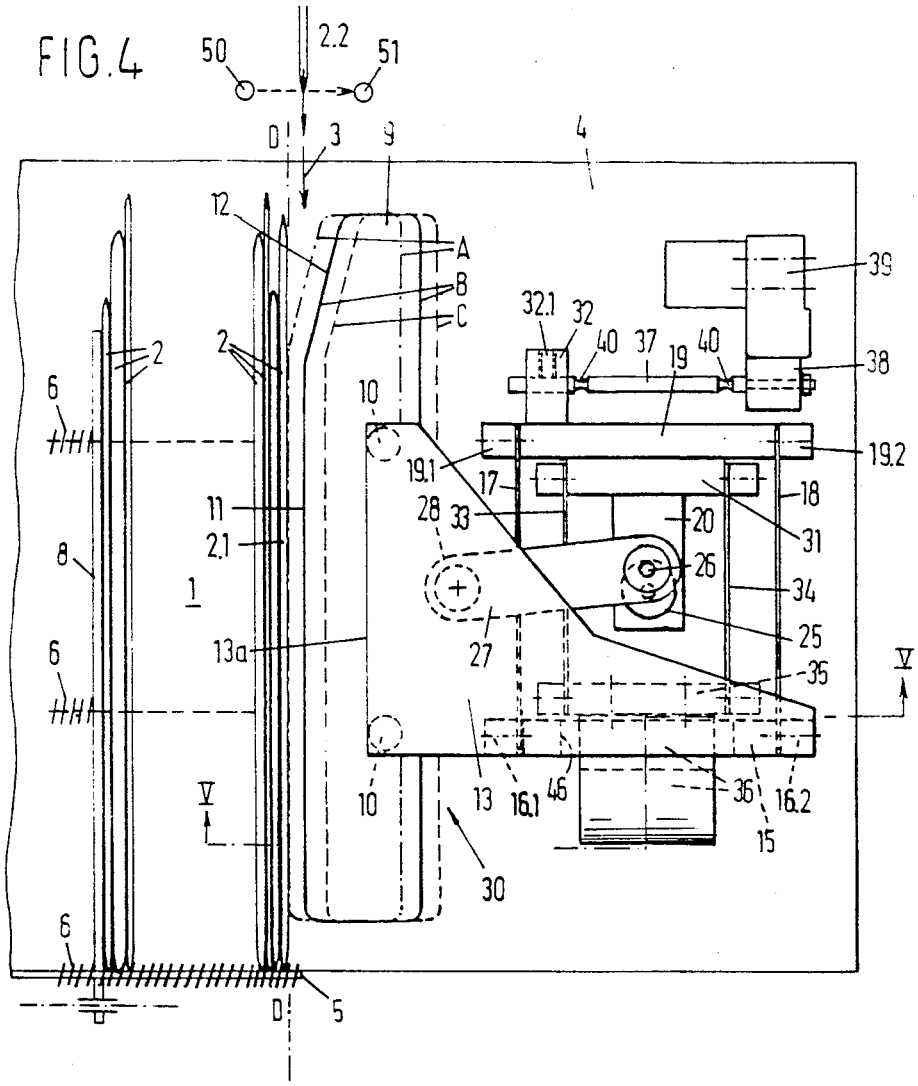
Figure 3:
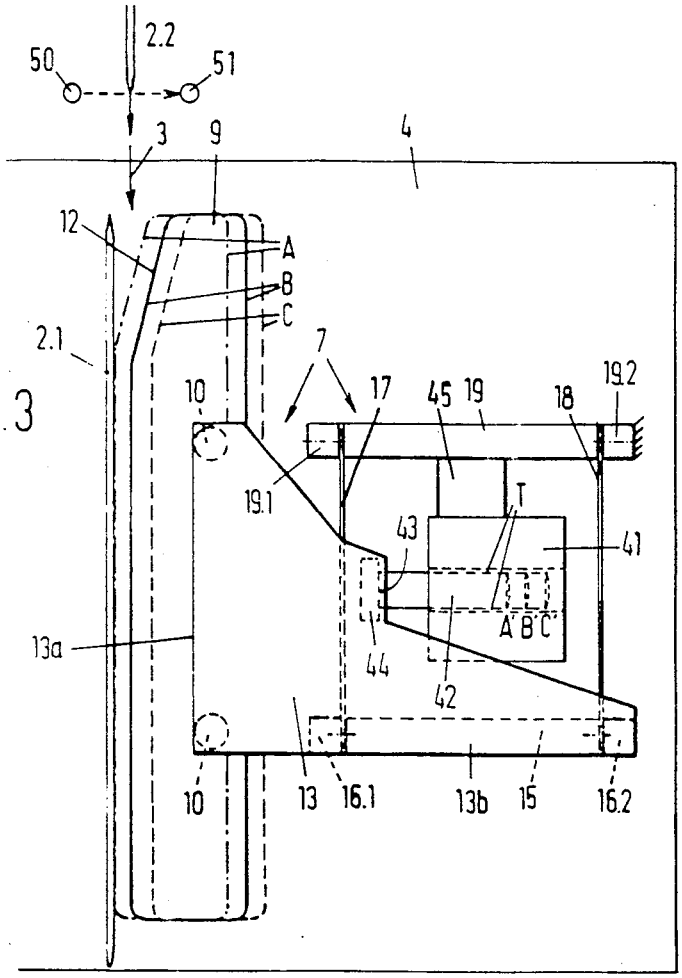
Figure 5:
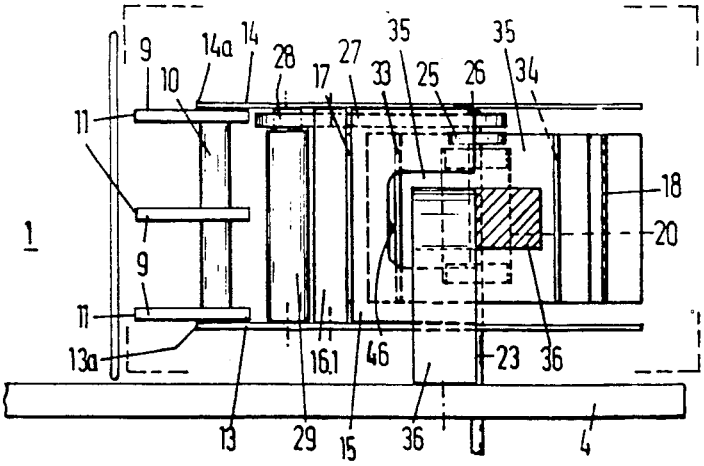

The invention will be elucidated hereinafter with reference to a drawing, of which FIG. 1 shows a diagrammatic representation of a stacking device according to the invention, FIG. 2 shows a diagrammatic representation of the device represented in FIG. 1 in the direction of view II indicated in that figure, FIG. 3 shows a diagrammatic representation of a part of the stacking device with a drive variant for the pulse movement, FIG. 4 shows a diagrammatic representation of a stacking device according to the invention, including a preferred stacking pressure detection, and FIG. 5 shows a diagrammatic representation of the device represented in FIG. 4 in the direction of view V indicated in that figure.

E. DESCRIPTION OF THE FIGURES

In FIG. 1 a stacking device according to the present invention is diagrammatically represented. FIG. 2 shows a different view, indicated by II in FIG. 1, of this device. In this FIG. 2, 1 designates a stacker bin in which letters 2, which are supplied via a supply line 3, which is not shown in detail and consists of for example a pair of co-operating conveyor belts, are stacked or have been stacked. The stacker bin 1 is formed by a base plate 4 and a stop plate 5 mounted at right angles to that plate 4. For the sake of the cross conveyance of the letters in the stack the stacker bin 1 is provided with for example a worm device known per se. This worm device can be driven and consists cf three worm shafts 6 extending in the longitudinal direction of the stack and disposed in the base plate 4 and the stop plate 5. Moreover, the stacker bin 1 is bounded at the one end near the supply line 3 by a stacker head 7 and possibly at the other end by a stack support 8 movable along for example a guide rail (not shown in detail). The stacker head 7 comprises as first guide means a number, in the case three, of parallel skate-shaped lead-in guides 9 rigidly coupled by means of one or more crossbars 10. Each lead-in guide 9 has a slide side 11 running substantially parallel to the supply line 3 and receding near the supply line 3 thus forming a bevelled edge 12. Parallel side plates 13 and 14 with a side **13*a* and 14*a* respectively are mounted along the outsides of the two outermost lead-in guides 9, which sideplates end in the parts 13*b* and 14*b* extending in a direction away from the slide side 11 of the lead-in guides 9. These extending parts of the side plates 13 and 14 are rigidly connected by means of a right-angled transverse plate 15 with a suitably chosen length in a plane extending substantially at right angles to the direction of the slide side 11. A first parallel leaf spring guide is formed by two right-angled parallel leaf springs 17 and 18 of equal suitably chosen dimensions and stiffness, which establish a flexible connection between or the one hand a transverse plate 15, to which the springs on one side are lengthwise fastened, and on the other hand to a frame part comprising a first yoke bar 19, to which the springs with the opposite side are fastened. This fastening of the parallel leaf springs 17 and 18 preferably takes place by clamping by means of the clamping bars 16.1 and 16.2 on both sides of the transverse plate 15, and on the opposite sides by means of the clamping bars 19.1 and 19.2 on both sides of the yoke bar 19. Said frame part also comprises a bearing block 20, which extends from the first yoke bar 19 in the space between the parallel leaf springs 17 and 18. The dimensions of the bearing block 20 are such that a shaft 23 carried on bearings 21 and 22 of the bearing block 20 lies halfway the height of the parallel leaf springs 17 and 18 in the plane parallel to and in the middle between the parallel leaf springs 17 and 18. The shaft 23 can have been extended on a one side 23*a* through an opening 24 in the base plate 4 and be connected there to drive means which are not shown in detail. On the other side (23*b*) of the bearing block 20 an eccentric 25 is mounted on the end of the shaft 23, which eccentric is provided with a spindle-shaped cam 26 eccentrically placed on it. A connecting rod 27 is rotatably coupled to the eccentric 25 via the spindle-shaped shaped cam 26, which is carried on bearings in a first bearing 27.1, which is placed in this connecting rod 27. When driving the shaft 23 the cam 26 on the eccentric 25 will describe a circle S, e.g. in a sequence via the positions $S_1$, $S_2$, $S_3$, $S_4$ to $S_1$ again, which positions are indicated on the circle S. The driving end 28 of the connecting rod 27, which extends past the leaf spring 17 is rotatably coupled by means of a second bearing 27.2, placed in the connecting rod 27, to a crossbar 29, which is mounted parallel to the shaft 23 and halfway the height of the leaf springs 17 and 18 between the plates 13 and 14. The frame part (first yoke bar 19, including the clamping bars 19.1 and 19.2, bearing block 20) is rigidly connected to the base plate 4, which is considered to be the fixed world. The rigid whole formed by the parts numbered 9, —, 16.2 and 29 of the stacker head 7 will be called slide 30** in what follows.

The working is as follows:

Owing to the first parallel leaf spring guide formed by the double parallel leaf spring connection (17, 18) of the slide 30 with a supporting part (yoke bar 19, bearing block 20), which is connected with the fixed world, a spring coupling has been obtained between the lead-in guides 9 and the fixed world, due to which this slide 30 can make a to-and-fro motion in the longitudinal direction of the stack in the stacker bin. Moreover, a driving coupling has been obtained between the lead-in guides 9 and the fixed world. Via this driving coupling, which has been obtained via the connecting rod 27, the to-and-fro motion can be imposed on the slide 30. This motion will be effected when due to a drive (not shown in the figure) on the shaft 23 supported on bearings in the bearing block 20 the circular motion of the cam 26 of the eccentric 25 along the circle S is converted into a practically linear transverse displacement of the crossbar 29 rotatable in the driving end 28 of the connecting rod 27. If position S: has been chosen as the initial position of the spindle-shaped cam 26, the slide 30 together with the lead-in guides 9 will be at rest in the stack pressing position A, in which position they (9) push with their slide side 11 against the last 2.1 of the letters 2 in the stacker bin 1. If now in the supply line 3 a next letter 2.2 is presented to be stacked, then the shaft 23 will be turned one revolution at a suitably chosen moment and at a suitably chosen speed of revolution. This can be achieved for example by driving the shaft 23 by means of a known single-stroke clutch, which is not shown in detail in the figure Consequently, the cam 26 will describe a circle S from the initial position chosen, in this case position $S_1$, to which position A of the lead-in guides 9 belongs, via the position $S_2$ to which the intermediate position B of the lead-in guides 9 belongs, to the position $S_3$, in which the lead-in guides 9 take up their outermost position C, and then via the position $S_4$, to which again the intermediate position B of the lead-in guides 9 belongs, back again to the position $S_1$, chosen as the initial position, to which position $S_1$ the position A of the lead-in guides 9 belongs. In theory any point on the circle S can be chosen as an initial position of the cam 26. For practical reasons only a limited number of positions will be appropriate to the said initial position in the case of the go-through direction chosen. For example $S_1$ as an initial position has the advantage that, when starting the pulse movement, the pulling force of the spring coupling will support the movement of the driving coupling. $S_4$ as an initial position has the advantage that the spring coupling in its rest position will not be charged.

In the following description $S_1$ is supposed to be the initial position with the rest position A. In this description the driven to-and-fro motion along the positions A,B,C,B,A of the lead-in guides, when only once going-through the circle S from a given initial position, is called pulse movement. The duration of one pulse movement has to be chosen in such a way that it will be attuned to (a) the applied speed of the letters entering via the supply line, and (b) the highest speed at which the end of the last letter 2.1 near the supply line 3 can fall aside in the stack or, under the stacking pressure occurring in the stack, can be pushed into the stacking space created during the pulse movement.

The starting of the pulse movement, that is the beginning of the activation of the shaft 23 of the eccentric 25 by the driving means, which are not shown in detail, has of course to be well attuned to the moment when a letter 2.2 to be stacked enters the supply line 3. This can be realized for example, if the stacking device according to the invention is used in the case of a letter transport with a fixed pitch, by rigidly linking the beginning of the activation to the beginning of the pitch. The drive means, however, can also be activated dependent on the letter detection signals coming from letter detecting means, such as opto-electrical detecting means 50, 5 , preferably of the "through-beam" type, on the leading edge of the letters in the letter transport path. The drive means, which are not shown in detail, for driving the shaft 23 of the eccentric 25 can be those of the supply path which are coupled to the shaft 23 via for example a single-stroke clutch known per se. On reception of a control signal, in this case a letter detection signal, this single-stroke clutch for starting the pulse movement causes the eccentric 25 to make a revolution due to which the pulse movement will be carried out by the slide 30.

From experiments it appears that when attuning to a usual entering speed corresponding to 10 letters to the second b) was also adequately attuned, so that a possible falling back of the last letter 2.1 will not disturb the entering, via a supply line 3, of a letter 2.2 to be stacked. It should, however, be seen to that the quick displacement of the lead-in guides 9 under the pulse movement will have the least possible sucking effect on the last letter 2.1 in the stack which is caused by an underpressure, if any, between the plane of the last letter 2.1 and the pushing surface formed by the lead-in guides. For that reason the lead-in guides 9 preferably have the form of a skate blade with their slide sides 11 as pushing surface with the advantage that said sucking effect will be minimal, and that their length can nevertheless thus be chosen so that their stack-supporting effect will be optimal. This means inter alia a choice of such a length that the chance that bending of the end of the last letter 2.1 in the stack, which still rises above the slide side, will have a disturbing effect on the entering of a next letter 2.2 to be stacked will be slim, even in the case of the greatest letter length allowable. Moreover, the lead-in guides 9 can also be provided with a bevelled edge 12 to attune the moment when a next letter 2.2 supplied via the supply line 3 enters even more sharply to the moment of starting the pulse movement of the slide 30 in order to create stacking space for this letter.

The way in which according to the invention stacking space for an entering letter 2.2 is created by means of the pulse movement implies that this letter, when entering, will freely move for a short time at a speed and in a direction obtained in the supply line 3. To prevent said letter from shooting through at too high a speed against the stop plate 5 in the stacker bin 1 and, consequently, will get damaged, it has to be slowed down in time. The principle of the pulse movement permits a simple realization of this slowing down process by choosing the pulse duration so short that at the end of the pulse movement an entering letter 2.2 will get sufficient stopping distance by clamping it in time between the lead-in guides 9 and the last letter 2.1 in the stack. Should an entering letter come to a stands&:ill before reaching the stop plate 5, then the next entering letter will, when being slowed down, push by friction also the preceding letter further in the direction of the stop plate 5.

In the embodiment of the invention described with reference to the figures 1 and 2 the pulse movement has been chosen substantially in a direction perpendicular to a plane of stacking D, which is formed by a plane in which the slide sides 11 of the lead-in guides 9 are, in their rest position A, in contact with the last letter 2.1 in the stack. Moreover, this plane of stacking D has been chosen parallel to the (extended portion of the) plane in which the letters 2.2 to be stacked are supplied via the supply line 3. Such an arrangement has the advantage that the amplitude of the pulse movement can be chosen equal to the maximum width desirable for the stack space, which width has to be attuned to the maximally permissible letter thickness. Moreover, the friction forces will have a more effective working on the slowing down process of an entering letter 2.2 at the end of the pulse movement due to an orthogonally directed clamping between the lead-in guides 9 and the last letter 2.1 in the stack. The position of the crossbar 29 and, consequently, of the driving end 28 of the connecting rod 27 in a plane extending through the middles of the leaf springs 17 and 18 perpendicular to a resilient longitudinal direction has been chosen to prevent unwanted push and pull forces in the leaf springs as much as possible.

Instead of a connecting rod mechanism with an eccentric it is also possible to choose, with advantage, such a mechanism provided with a linear electromagnetic converter: there are no rotating parts and there is no need for a special coupling such as a single-stroke clutch to drive means located behind. FIG. 3 shows part of the stacker head 7 with a linear drive 4 provided with a linear connecting rod 42, the driving end 43 of which engages with the middle of a bridge portion 44, which forms a perpendicular rigid connection between the two parallel side plates 13 and 14. The linear drive 41 is mounted on a mounting block 45, which extends from the first yoke bar 19 in the space between the parallel leaf springs 17 and 18. As a linear drive 41 may be chosen for example a magnetic coil with a plunger armature (soft iron core) as a linear connecting rod 42. For the sake of the small vertical displacement of the slide 30 occurring during the pulse movement there is, in this case, in general so much play T between the iron core and the coil that the driving end 43 of the linear connecting rod 42 can be rigidly connected to the bridge portion 44. If there is no such play T, then the driving end 43 can be coupled to the bridge portion 44 via a double pivoting or flexible connecting piece. The dimensions of the mounting block 45 and of the linear drive 41 have been chosen in such a way that the longitudinal axis of the linear connecting rod 42 about coincides with the connecting line of the points of intersection of the diagonals of the rectangles which form the two parallel leaf springs 17 and 18. The positions A,, B, and C, correspond with the positions A, B and C respectively of the slid ®. Only the, in the figure right-hand, end of the linear connecting rod 42 has been shown in those positions.

The fact that there are a spring coupling as well as a driving coupling between the slide 30 and the frame part can be utilized with advantage as described in what follows.

The slide 30 consisting of the rigidly connected parts numbered 9, —, 16.2 and 29(or 9, —, 16.2 and 44, and possibly 42, in the case of a linear drive according to FIG. 3) has a certain mass and hanging on the parallel leaf springs 17 and 18 it forms a mass spring system with a certain frequency of its own. By means of a suitable choice of the dimensions of the parallel leaf springs 17 and 18 this own frequency is chosen as much as possible equal to the frequency belonging to the desired pulse duration of a pulse movement. This means that the pulse movement will become approximately an undamped oscillation, which has the attendant advantage of little loss of energy.

Owing to the skate-shape of the lead-in guides 9 a sucking along working on the last letter 2.1 in the stack will, when starting the pulse movement, already be slight. This working can, however, be reduced to a minimum by disposing a fixed (that is: rigidly connected to, for example, the base plate 4) partition (not shown), placed about near the plane formed by the slide sides 11 of the lead-in guides 9 in position C. This portion must have slot-shaped openings permitting the to-and-fro motion of the skate-shaped lead-in guides 9. The stack space to be formed by the pulse movement will be kept free by such a partition from adverse influences of the movements of the air, which can be caused due to the displacement of the slide 30, particularly when the pulse movement is started. The partition can also be designed as a slide plate and then placed in a plane between the planes formed by the slide sides of the lead-in guides 9 in the positions B and C. It has appeared by experiment that the entering process of a letter 2.2 to be stacked and supplied via the line 3 can be promoted by providing another conveyor belt (not shown in the figures) as second guide means in the space between two consecutive skate-shaped lead-in guides 9 and to let it run along at the same speed at which and in the same direction in which letters are supplied via the line 3, the engaging surface of said conveyor belt being about in a plane formed by the slide sides 11 of the lead-in guides 9 in position B. In case letters are supplied via the supply line 3 by means of two co-operating conveyor belts, a running-along conveyor belt of the aforesaid type can be realized in a simple way by extending one of said co-operating conveyor belts in the above sense. Starting from the slide 30 in position A the bevelled edge 12 of the lead-in guide 9 preferably reaches in this case past said engaging surface of the conveyor belt. Such a conveyor belt as second guide means can, at least partly, also perform the same function as the partition mentioned above, due to which at least part of this partition can be left out.

As already mentioned above it is a known fact that with stacking devices of the sort to which also the present invention belongs, the stacker head is, moreover, used as a detection device for measuring the pressure which letters in the stack exert on one another, id est the stacking pressure. A device according to the invention in which the slide of the stacker head 7 carries out, under the pulse movement, a to-and-fro translation, and at the end of this movement is always compelled to return to the plane of stacking D, offers the possibility for a stacking pressure detection by means of a verY accurate force measurement. The above will now be explained with the aid of FIGS. 4 and 5, which figures correspond to, but are extensions of FIG. 1, respectively FIG. 2. Correspondingly numbered parts have the same meaning. The frame part comprising the first yoke bar 19 and the bearing block 20 is now no longer directly (rigidly) connected to the fixed world, in this case the base plate 4, but indirectly, notably in two ways. For that purpose the frame part is extended by a second yoke bar 31 mounted between the first yoke bar 19 and the bearing block 20, and by a top piece 32 fixedly mounted on for example the first yoke bar 19. A second parallel leaf spring guide formed by a second set of right-angled parallel leaf springs 33 and 34 is mounted between and parallel to the parallel leaf springs 17 and 18 of the first set on the one hand on the second yoke bar 31 and on the other hand on a supporting beam 35, which is fixedly mounted on a supporting block 36 extending through an opening 46 in the crosplate 15 and between the parallel leaf springs 17 and 18 of the first set, which supporting block is on another side rigidly coupled to the base plate 4 acting as the fixed world. The coupling bar 37 extending in a direction perpendicular to the plane of stacking D is at its one end adjustable in its longitudinal direction by means of an adjusting screw 32.1 mounted in the top piece 32 and at its other end rigidly coupled to a measuring element 38 of a force transducer 39 known per se and rigidly mounted on the base plate 4. Between and near the two fixed ends of the coupling bar 37 there are narrowed portions 40 forming two resilient joints.

A force measurement will now be feasible because of the fact that the frame part (19, 20, 31, 32) has been disconnected, by means of the second parallel leaf spring guide, from the fixed world only in the desired direction, id est in a direction perpendicular to the plane of stacking D. By moreover dimensioning the second parallel leaf spring guide in a suitable way, it can be ensured that the stacking force measurement in the plane of stacking D will take place independently as to place. The measured force will be converted by the force transducer 39 into an electric signal, which is presented for processing to a control device (not shown in the figures) known per se. To prevent the measurement from being adversely influenced the drive of the shaft 23 of the eccentric has to be flexible, but yet torsional stiff. For that purpose the shaft and the drive can have been coupled by means of for example a type of a torsional stiff coupling with spring discs (made by Thomas). The narrowed portions 40 with which the coupling bar 37 is provided serve to effect a great stiffness in the force measurement direction and a small stiffness, id est a great flexibility, in the other directions.

The working of the stacking force measurement is as follows:

In the rest position A of the slide 30 the stacker head 7, that is the composition of the slide 30 and the frame part coupled to it via the first set of parallel leaf springs (17, 18) and the eccentric/connecting rod combination (25–28), forms a rigid whole. The pressure from the stack in/over the plane of stacking exerted on the slide sides 11 of the lead-in guides 9 is, consequently, exerted as a pushing force on the frame part. Under this pushing force the parallel leaf spring connection (set of leaf springs 33, 34) of the frame part with the fixed world can permit, against spring action, a very small sideways displacement, which, transmitted via the connecting rod 37 to the measuring element 38 of the force transducer 39 can be registered at the same time. A signal corresponding to said displacement will be delivered by the force transducer 39 to the aforesaid control device, from which, dependent on the value of the signal, the displacement of the stack support 8 can be effected to control the stacking pressure. Because of the fact that during a pulse movement of the slide 30 the stacking pressure can no longer be transmitted to the measuring element 38 of the force transducer 39 due to a short interruption of the rigid connection between the slide and the frame part, the signal delivered by this force transducer will be disturbed during such a pulse movement. These disturbances can, hoWever, be simply filtered away from the signal by known means or ignored by/in the control device, so that the pushing force measurement can be continued uninterruptedly. Consequently, the force at which the stack presses against the stacker head can be very accurately kept at a constant. value, which guarantees an even working of the stacking device.

In the embodiments the lead-in guides 9 are disposed within the planes of the parallel side plates 13 and 14. This is, however, by no means necessary. The crossbars 10 can also have been extended to one side as far as past the row of lead-in guides 9 and be rigidly coupled there to the parallel side plates 13 and 14 extending perpendicular to said crossbars. Owing to this it will be possible for the crossbars 10 to extend through the base plate 4 through openings of a size which permits at least the pulse movement of the slide 30. The parallel leaf spring guide(s), the drive and the provisions made for the sake of the stacking force measurements can in this case also be located entirely under the base plate 4. As a rule there is no lack of space under the base plate 4 and, consequently, the need of compactness will be less great. In that case neither the drive and, when it concerns a stacking device with stacking force measurement, nor the second parallel leaf spring guide need preferably be placed between the first set of parallel leaf springs 17 and 18, but they can be mounted outside these leaf springs on the first yoke bar 19 or possibly on an extended part of it.

I claim:

1. Device for stacking sheet-like articles, such as letters, side by side in an upright state, which articles are separately supplied via a supply path which defines a plane of supply in the neighborhood of the device, which device comprises:

a. a stacker head provided with first guide means movable across the supply path and with means for moving the first guide means in a to-and-fro motion, and b. a stacker bin, in which the articles are stacked to form a stack which is bounded on one side by the first guide means, said to-and-fro motion causing the provision between the first guide means and the stack, at least on the side towards of the supply path, of a space during a short time interval for insertion of a next entering article to be stacked, characterized:

in that the plane of supply is substantially the same as a plane of stacking in which the last previous of said sheet-like articles, if any, is aligned;

in that the first guide means are aligned with said plane of supply, are movable perpendicular thereto and have a rest position in which position said guide means support the stack, and in that said means for moving the first guide means include a spring coupling with a frame part forming part of the stacker head, and also a driving coupling with said frame part, such that the first guide means and the spring coupling form a mass and spring system which has a frequency of its own which is chosen approximately equal to the frequency which corresponds with the pulse movement applied via the driving coupling, for imposing on said first guide means discrete cycles of a to-and-fro pulse movement, from a stack-pressing rest position, which discrete cycles of pulse movement are synchronous with the supply of said respective articles, each of which movement cycles forms a translation approximately perpendicular to the plane of stacking, through it, up to beyond the plane of supply.

2. Device according to claim 1, characterized in that the driving coupling is set in such a way that the stack pressing rest position of the first guide means is established when the spring coupling is in its outermost position, in which case each said cycle of pulse movement is started in a direction away from the stack.

3. Device according to claim 1, characterized in that the stack pressing rest position of the first guide means is established when the spring coupling is not charged, in which case each said cycle of the pulse movement is started towards the stack.

4. Device according to claim 1, characterized in that the spring coupling is formed by a first parallel leaf spring guide and in that the driving coupling comprises a connecting rod mechanism provided with a connecting rod the driving end of which is pivotally connected to the first guide means, the connecting rod mechanism being carried on bearings in the frame part in such a position that the movement of the driving end is in a plane substantially orthogonal to the plane of stacking.

5. Device according to claim 4, characterized in that the driving end of the connecting rod is mainly in a plane extending through the middles of right-angled leaf springs perpendicular to their springy longitudinal direction, which leaf springs form part of the first parallel leaf spring guide.

6. Device according to claim 4, in which the stacker head serves as a device for detecting the stacking pressure, characterized in that the stacker head is connected from inside of or from the frame part to the environment designated as the fixed world, on the one hand via a second parallel leaf spring guide parallel to the first parallel leaf spring guide, and on the other hand via a force transducer.

7. Device according to claim 6, characterized in that a rigid coupling bar extending perpendicular to the plane of stacking forms at its both ends, via material narrowings, the connection between the frame part and a measuring element, which forms part of the force transducer.

8. Device according to claim 6, characterized in that parallel leaf springs forming part of the second parallel leaf spring guide are disposed between the leaf springs of the first parallel leaf spring guide.

9. Device for stacking sheet-like articles, such as letters, side by side in an upright state, which articles are separately supplied via a supply path, which device comprises:

a. a stacker head provided with first guide means aligned with the supply path which are provided with a spring coupling as well as with a driving coupling, with a frame part forming part of the stacker head, and b. a stacker bin, in which the articles are stacked to form a stack which is bounded on one side by the first guide means, which when in a stack pressing position determine a plane of stacking which first guide means carry out a to-and-fro motion, due to which between the first guide means and the stack, at least on the side of the supply path, space will be made for a short time for a next entering article to be stacked, characterized in that the plane of supply is substantially parallel to the plane of stacking, in that the to-and-fro motion is an imposed pulse movement from a stack pressing rest position synchronous with the supply, which movement forms a translation approximately perpendicular to the plane of stacking, through it up to beyond the plane of supply, in that the spring coupling is formed by a first parallel leaf spring guide, in that the driving coupling comprises a connecting rod mechanism provided with a connecting rod the driving end of which is pivotally connected to the first guide means, the connecting rod mechanism being carried on bearings in the frame part in such a position that the movement of the driving end is in a plane substantially orthogonal to the plane of stacking and in that the first guide means and the spring coupling will form a mass spring system, which has a frequency of its own which is chosen approximately equal to the frequency which corresponds with the pulse movement imposed via the driving coupling.

10. Device according to claim 9, in which the stacker head serves as a device for detecting the stacking pressure, characterized in that the stacker head is connected from inside of or from the frame part to the environment designated as the fixed world, on the one hand via a second parallel leaf spring guide parallel to the first parallel leaf spring guide, and on the other hand via a force transducer.

11. Device according to claim 10, characterized in that a rigid coupling bar extending perpendicular to the plane of stacking forms at both its ends, via material narrowings, the connection between the frame part and a measuring element, which forms part of the force transducer.

12. Device according to claim 10, characterized in that parallel leaf springs forming part of the second parallel leaf spring guide are disposed between the leaf springs of the first parallel leaf spring guide.

13. Device for stacking sheet-like articles, such as letters, side by side in an upright state, which articles are separately supplied via a supply path, which device comprises:

a. a stacker head which serves as a device for detecting stacking pressure and is provided with first guide means aligned with the supply path which are provided with a spring coupling as well as with a driving coupling with a frame part forming part of the stacker head, and b. a stacker bin, in which the articles are stacked to form a stack which is bounded on one side by the first guide means, which when in a stack pressing position determine a plane of stacking which first guide means carry out a to-and-fro motion, due to which between the first guide means and the stack, at least on the side of the supply path, space will be made for a short time for a next entering article to be stacked, characterized in that the stacker head is connected from inside of or from the frame part to the environment designated as the fixed world, on the one hand via a second parallel leaf spring guide parallel to the first parallel leaf spring guide, and on the other hand via a force transducer, in that the plane of supply is substantially parallel to the plane of stacking, in that the to-and-fro motion is an imposed pulse movement from a stack pressing rest position synchronous with the supply, which movement forms a translation approximately perpendicular to the plane of stacking, through it up to beyond the plane of supply, in that the spring coupling is formed by a first parallel leaf spring guide, in that the driving coupling comprises a connecting rod mechanism provided with a connecting rod the driving end of which is pivotally connected to the first guide means, the connecting rod mechanism being carried on bearings in the frame part in such a position that the movement of the driving end is in a plane substantially orthogonal to the plane of stacking, in that the first guide means and the spring coupling will form a mass spring system, which has a frequency of its own which is chosen approximately equal to the frequency which corresponds with the pulse movement imposed via the driving coupling and in that article detecting means are provided in the supply path for producing and article detection signal for starting the pulse movement.

14. Device according to claim 13, characterized in that a rigid coupling bar extending perpendicular to the plane of stacking forms at its both ends, via material narrowings, the connection between the frame part and a measuring element, which forms part of the force transducer.

* * * * *

UNITED STATES PATENT AND TRADEMARK OFFICE

CERTIFICATE OF CORRECTION

PATENT NO. : 4,951,934

DATED : August 28, 1990

INVENTOR(S) : Geert J. Prins

It is certified that error appears in the above-identified patent and that said Letters Patent is hereby corrected as shown below:

Title page, Section [30] Foreign Application Priority Data:

Change "Nov. 20, 1986" to --Nov. 20, 1987--.

Column 1, line 31, change "BeYond" to --Beyond--.

Column 1, line 38, change "angle o" to --angle a--.

Column 2, line 19, change "angle o" to --angle a--.

Column 2, line 55, change "bY" to --by--.

Column 4, line 11, delete "5".

Column 5, line 33, change "cf" to --of--.

Column 6, line 51, change "S:" to --$S_1$--.

Column 6, line 62, insert --.-- after "figure".

Column 7, line 41, change "50, 5 ," to --50, 51--.

Column 8, line 62, change "drive 4" to --drive 41--.

UNITED STATES PATENT AND TRADEMARK OFFICE

CERTIFICATE OF CORRECTION

PATENT NO. : 4,951,934

DATED : August 28, 1990

INVENTOR(S) : Geert J. Prins

It is certified that error appears in the above-identified patent and that said Letters Patent is hereby corrected as shown below:

Column 9, lines 17 and 18, change "A,, B, and C," to --A', B' and C'--.

Column 9, line 19, change "slid®" to --slide--.

Signed and Sealed this

Eighteenth Day of August, 1992

*Attest:*

DOUGLAS B. COMER

*Attesting Officer*

*Acting Commissioner of Patents and Trademarks*